United States Patent [19]

Miller

[11] Patent Number: 4,875,732

[45] Date of Patent: Oct. 24, 1989

[54] CHAIR CONSTRUCTION

[76] Inventor: Anthony D. Miller, 2103 Emerson Ave. South, Minneapolis, Minn. 55405

[21] Appl. No.: 221,899

[22] Filed: Jul. 20, 1988

Related U.S. Application Data

[63] Continuation of Ser. No. 46,658, May 4, 1987, abandoned.

[51] Int. Cl.[4] ..... A63G 9/10

[52] U.S. Cl. ..... 297/181; 297/455; 297/DIG. 1; 297/DIG. 2

[58] Field of Search ..... 297/463, 417, 456, 455, 297/458, 459, 481, 443, DIG. 1, DIG. 2, 181; 446/369, 372

[56] References Cited

U.S. PATENT DOCUMENTS

| | | | |
|---|---|---|---|
| 3,713,697 | 1/1973 | Koepke | 297/456 |
| 3,751,111 | 8/1973 | Taylor et al. | 297/456 |
| 3,893,731 | 7/1975 | Naggs | 297/456 |
| 4,179,158 | 12/1979 | Flaum | 297/456 |
| 4,432,110 | 2/1984 | Sutton | 5/481 |
| 4,648,851 | 3/1987 | Rosenberg | 446/369 |

FOREIGN PATENT DOCUMENTS

| | | | |
|---|---|---|---|
| 467608 | 3/1969 | Switzerland | 297/181 |

*Primary Examiner*—James T. McCall

*Attorney, Agent, or Firm*—Lawrence M. Nawrocki

[57] ABSTRACT

A chair (10) designed for its comfort, ease of operation, and therapeutic effect. The chair (10) includes an envelope (12) having first and second portions (14, 24). The first portion (14) defines a reservoir (16) therein, and the second portion (24) has a pillar-like member (28) received within an interior (26) thereof. The interior (26) of the second portion (24) communicates with the reservoir (16) defined within the first portion (14) of the envelope (12), and the pillar-like member (28) is sufficiently long so that, when it is received within the interior (26) of the second portion (24) of the envelope (12), it will extend into the reservoir (16). The reservoir (16) is filled with a volume of fill (18) which, typically, comprises stryofoam beads (20). The base (30) of the pillar-like member (28) is immersed within the fill (18), and the fill (18) is of a consistency and density so that, unless a threshhold pressure applied to the pillar-like member (28) is imposed, the member (28) will tend to maintain its position relative to the rest of the envelope (12).

12 Claims, 1 Drawing Sheet

CHAIR CONSTRUCTION

This is a continuation of copending application Ser. No. 046,658 filed on May 4, 1987, now abandoned.

TECHNICAL FIELD

The present invention deals broadly with the field of furniture. More narrowly, however, the invention is directed to a chair which is designed, specifically, for comfort and the therapeutic effect which it affords. A preferred embodiment of the invention comprises such a chair which is configured as a bird and, more specifically, as a water fowl, such as a duck or loon.

BACKGROUND OF THE INVENTION

In furnishing a home, owners are, typically, concerned about two factors. These factors are functionality and aesthetic apperance.

The above factors are relevant regardless of the type of furniture in question. Certainly, it can be said that these factors apply to chairs, and they are given consideration by a home owner when purchasing chairs for his or her residence.

The features that it would be desirable for a chair to have will vary depending upon the application which the furniture item is to serve. For example, a dining room chair should be comfortable yet, at the same time, facilitate proper posture for the taking of a meal so that good digestion is fostered. On the other hand, a living room or family room chair should provide comfort, and even therapeutic treatment for the user.

In selecting a chair for a game room or family room, a purchaser might consider aesthetic appearance as a feature to which more importance is to be given than in the case of, for example, a kitchen chair. This is not to say that aesthetic appearance is totaly unimportant in chosing chairs for a kitchen or a dining room. Certainly, appearance is always a consideration regardless of the room for which the purchase is to be made. Rooms such as dens and family rooms, however, allow for greater reflection of the taste and personality of the homeowners.

One type of chair typically used in living rooms, dens, and family rooms is known as a "recliner". A back support of such a chair is, typically, oriented generally vertically when it is in its normal position. The back support, however, can be angled increasingly closer to the horizontal, if the user so desires, in order to make the chair more comfortable. The reclined configuration is, typically, one which is chosen during the evening hours and might be employed while the user is watching television.

Most recliners of which Applicant is aware are ones wherein a mechanical linkage between a seat support and a back support is provided. In some recliners, the seat support remains, basically, in a fixed position, and the back support is permitted to pivot angularly downward. A number of reclining-type chairs employ foot rests which can be elevated, or which are automatically elevated, as the back support is angled downward.

More recent developments in the chair art have provided reclining chairs wherein the seat support slides forward as the back support is depressed. Such a construction enables the chair to be used so that, regardless of the orientation of the back support, the chair can be, substantially, at a fixed distance from the wall against which it is positioned. That is, although the back support is being depressed backward and would normally get closer to the wall and even engage the wall as it becomes further depressed, because the seat support to which it is pivoted slides forward, the upper extremity of the back support maintains, substantially, a constant distance from the wall.

In the case of chairs discussed here-in-before, however, the linkage and relationship between the seat support and back support is constant, and, consequently, does not take into account the variations between the anatomies of different people. These variations are sometimes subtle, sometimes not so subtle.

Chairs are known in the art wherein the contours thereof are such that they can conform to the lines and curves of a person's body, regardless of who the person using the chair is. That is, as a person sits in a chair of this type, its contours will be rearranged to conform to the person's shape.

Such chairs can be rearranged because of fill provided therein which allows movement and relocation thereof in response to forces applied to the chair by the person sitting therein. The filling, or stuffing, is, typically, soft and such that it can distort or move to another location in response to the application of forces One chair of this type is known as a "bean bag" chair.

While these chairs can have therapeutic value in that they can conform to the specific anatomy of the person sitting therein, they do have certain disadvantages. For example, because of the nature of the stuffing employed in order to obtain the contour conformability advantage, it is difficult to provide a back support which offers reasonable resistance to pressures applied as a person sitting in the chair leans back. What is gained in one aspect of the chair, therefore, is lost in another. Not only might such a chair make it difficult for a user to get into and out of the chair, but it might even cause injury by way of muscle pull, particularly if the person is old or has poor muscle tone.

It is to these deficiencies of the prior art and implied desirable features of a chair that the present invention is directed. It is an improved chair which not only allows substantial conformability to the user's particular contours, but is also provides a back support which is firm enough to have a therapeutic effect and which is controllable by the user of the chair.

SUMMARY OF THE INVENTION

The present invention is an improved chair which provides comfort, practicability, and therapeutic effect. It includes a flexible, collapsible fabric envelope which has first and second portions. The first portion defines a reservoir therewithin, and the second portion is generally tubular in shape and has an interior which communicates with the reservoir. Typically, the second portion is disposed proximate the periphery of the first portion and is able to be extended upward from the first portion. A generally pillar-like member is received in the second portion of the envelope and has a base which extends downwardly into the reservoir. The reservoir is filled with a quantity of fill, and the fill encircles the base of the pillar-like member, that member being immersed in the fill. The fill has a consistency and a density such that it will tend to maintain the pillar-like member at whatever angle, relative to a surface on which the chair is disposed, at which it rests. If a force equal to, or in excess of, a threshhold amount is applied to the pillar-like member, the characteristics of the fill are such that angular adjustment can be accomplished.

In a preferred embodiment, the pillar-like member includes an elongated columnar element, formed from a high density urethane foam material, and a block carried by the columnar element at a upper end thereof. In the preferred embodiment, the block is formed of a malleable material such as a low density urethane foam material.

In one embodiment, the chair can be configured in a whimsical motif. Specific constructions envision structuring the chair in the shape of a duck, a loon, and, possibly, other creatures. The first portion of the envelope can simulate the torso of the animal, the second portion simulating the animal's neck and head.

When the chair simulates a duck, for example, button-like elements can be provided to simulate the duck's eyes. These elements would be positioned in appropriate locations upon opposite sides of the second portion of the envelope. A cord passing through the second portion of the envelope to interconnect the button-like elements can function to maintain the pillar-like member at a location in the second portion of the envelope so that it is extending fully to the upper extremity of the second portion. A bore can be provided at an appropriate axial location along the pillar-like member to receive the cord, the cord maintaining the pillar-like member at the desired position relative to the second portion fabric.

Regardless of the motif of the chair, however, it has been found that expanded styrofoam beads optimally function as the fill. It has been found that such beads have appropriate characteristics to afford the proper combination of adjustability to the seat portion of the chair and resistance to movement of the pillar-like member through the beads.

In a preferred embodiment, shards of shredded urethane foam are interspersed throughout the styrofoam beads. It has been found that, by so interspersing the shredded urethane foam throughout the styrofoam beads, crushing of the beads is retarded.

The present invention is, thus, an improved chair construction which solves many of the problems of the prior art and affords features which are particularly desirable. Those features and advantages obtained in view thereof will be discussed in more detail in the DETAILED DESCRIPTION OF THE INVENTION and will become apparent in view of that discussion, the appended claims, and the accompanying drawing Figures.

DETAILED DESCRIPTION OF THE INVENTION

Figure 1:
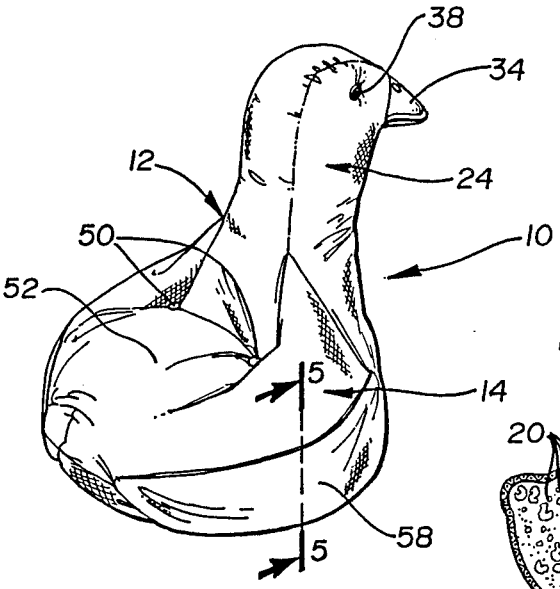
FIG. 1 is a perspective view of the preferred embodiment of a chair in accordance with the present invention.
Figure 2:
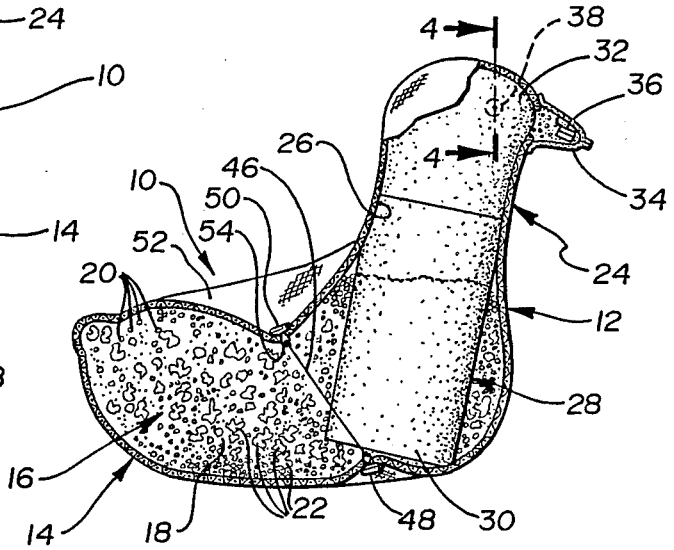
FIG. 2 is a right side elevational view of the chair of FIG. 1 cut away to show internal detail.

Referring now to the drawing wherein like reference numerals denote like elements throughout the several views, FIG. 1 illustrates a chair 10 in accordance with the present invention wherein configuration is in a whimsical duck motif. The chair 10 is defined by an envelope 12 which is flexible and, if not extended to an appropriate form and shape, collapses. The envelope 12 can be structured so that, when it is filled out, it is in the shape, for example, of the duck, as illustrated in FIGS. 1 and 2.

A first portion 14 of the envelope 12, or flexible bag, simulates, in the embodiment illustrated, the torso of a duck. As seen in FIG. 2, the first portion 14 of the bag 12 defines a reservoir 16 therewithin. Shape and form are given to the bag first portion 14 by filling the reservoir with an appropriate fill 18. Access can be provided to the reservoir 16 through a zippered seam (not shown) or other type of access opening.

It has been found that an appropriate fill 18 to give the chair 10 characteristics as will be discussed hereinafter comprises styrofoam beads 20. In one embodiment, styrofoam beads 20 having a cross sectional dimension of significantly less than one inch have been used. As will be apparent, therefore, in view of this disclosure, thousands of such beads 20 would be employed to fill the reservoir 16 sufficiently to give the desired shape, form, and ability to conform to the anatomy of the person sitting the chair 10.

Because of the relative fragility of such styrofoam beads 20, the preferred embodiment of the invention envisions employment of shredded urethane foam 22 interspersed in the beads 20 throughout the reservoir 16. It has been found that, by so interspersing the shards 22 of urethane foam, the deterioration of the beads 20 by crushing, which might result from a person sitting in the chair 10, can be retarded.

The envelope 12, further, includes a second portion 24 which is attached to the first portion 14 and is able to extend upwardly therefrom. In the particular whimsical embodiment illustrated in FIGS. 1 and 2, the second portion 24 of the envelope 12 simulates the neck and head of a duck.

The second portion 24 is an extension of the first portion 14 of the bag 12 and, typically, is made of the same material as the first portion 14 thereof. An interior 26 to the envelope second portion 24 communicates with the reservoir 16 and, as the fill 18 gives some measure of shape and form to the first portion 14 of the envelope 12, a pillar-like member 28 is receivable in the second portion 24 to give shape and form thereto.

As seen in FIG. 2, the pillar-like member 28 is sized to substantially fill out the second portion 24 of the envelope 12, and it has a length so that a base 30 thereof extends substantially to a surface on which the chair 10 is disposed. As will be able to be seen, therefore, the pillar-like member 28 extends from the second portion 24 of the envelope 12 and downwardly into the reservoir 16. Consequently, the base 30 of the pillar-like member 28 is immersed in the fill 18 occupying the reservoir 16.

Figure 3:
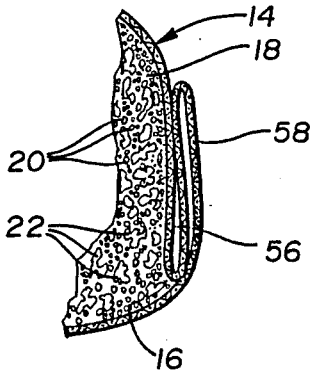
FIG. 3 is a pictorial view of the pillar-like element used to provide extension of the second portion of the chair envelope.

FIG. 3 illustrates the construction of the member 28 filling the second portion 24 of the envelope 12. The base 30 of the member 28, in the embodiment illustrated, takes the form of an elongated columnar element. This element is, it is envisioned, formed from a high density urethane foam material.

Mounted on top the columnar element 30 is a block 32. The block 32 is, it is envisioned, formed from a low density urethane foam material and, consequently, is much more malleable.

The columnar element base 30 of the pillar-like member 28 is shown as being cylindrical, and the block 32 is shown as being cubical. Since the block 32 is of low density foam, however, it can readily conform to the shape of the skin in which it is contained. It will be understood that the specific configuration of the pillar-like member 28 is not exclusively intended to be as shown in the Figures.

As seen in FIG. 2, the portion of the envelope 12 simulating the neck and head of the duck can be provided with ornamentation. For example, a beak 34 can be secured at a desired location by appropriate means. The beak 34 can be made from leather or a similar material. The embodiment illustrated in FIG. 2 is provided with mechanical means 36 to simulate the sound of a duck.

Figure 4:
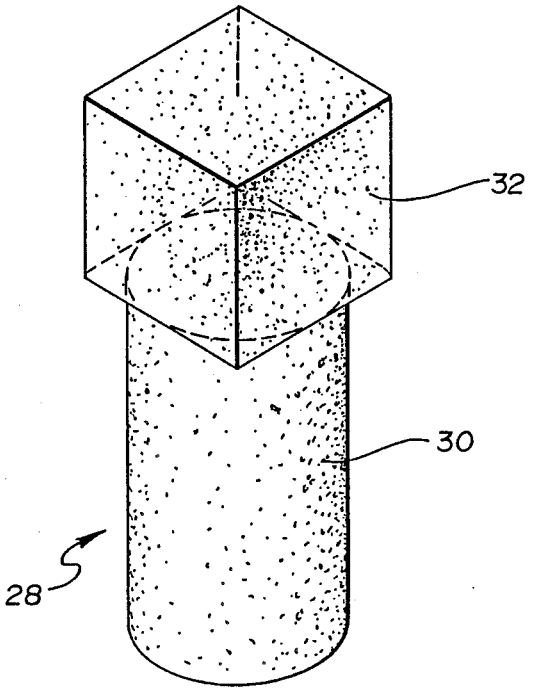
FIG. 4 is a sectional detail view taken generally along line 4—4 of FIG. 2.
Figure 5:
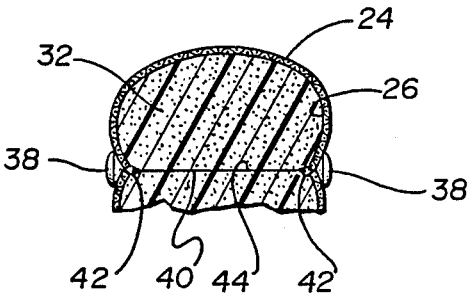
FIG. 5 is a sectional detail view taken generally along line 5—5 of FIG. 1.

Button-like members 38 can be applied at appropriate locations on opposite sides of the second portion 24 of the envelope 12. Any acceptable means can be employed to secure the simulated eyes 38 in place. One means contemplated by the invention would utilize a cord 40, passing through the low density foam portion 32 of the pillar-like member 28. The cord 40 would extend, as illustrated in FIG. 4, from an eyelet 42 associated with each button-like element 38. The cord 40 would be of an appropriate length so that the simulated eyes 38 would be held against the surface of the second portion 24 of the envelope 12 bag in their respective locations.

The cord 40 could serve an additional function, thereby. As seen in FIG. 4, the cord 40 could be made to extend through a small-diameter channel extending through the low density foam portion 32 of the pillar-like member 28. The channel 44 could be passed through the block 32 at an axial location therealong so that, when the cord 40 is received in the channel, the upper extremity of the block 32 would push against the portion of the head simulation structure to hold the neck and head in an erect orientation.

The first portion 14 of the envelope 12 is, in some embodiments, provided with stays 46 which extend upwardly from pads 48 placed symmetrically with respect to the center-line of the torso simulating structure. A stay 46 extends upwardly from its corresponding pad 48 and is connected to a button 50 on an upper wall 52 of the reservoir 16 defining portion of the envelope 12. The buttons 50 have eyelets 54 for connection of the stays 46 and are located at positions generally symmetrical with respect to a centerline of the torso simulating structure. The torso is, thereby, more realistically simulated, and a more well defined seat support is, thereby, provided.

The fabric of which the bag 12 is made can be folded, on a side of the first portion of the envelope 12, upwardly upon itself to define a pouch 56. In an embodiment wherein the chair 10 is configured in a whimsical motif, the pouch 56 can be formed by segments 58 of the fabric which simulate wings. The pouches 56 thereby provided can function as magazine holders or pockets for knitting yarn, etc.

As will be able to be seen in view of this disclosure, the pillar-like member 28 can be maintained in any desired orientation within which it can be constrained by the second portion 24 of the envelope 12. Because of the consistency and density of the fill 18, the columnar element 30 will retain its orientation unless force is imparted thereto to reorient it. Typically, when the chair 10 is not occupied, the pillar-like member 28 would be oriented as seen in FIG. 2. A person sitting on the chair 10 would position himself or herself on the upper wall 52 of the first envelope portion 14 defining a seat support. The person would be able to employ the neck and head simulating structure as a back rest. He or she would be free to lean back and exert force upon the pillar-like member 28, and, once a threshhold pressure were exceeded, the pillar-like member 28 would become angled more acutely with respect to the horizontal. As the person would recline, the fill 18 in the reservoir 16 would tend to surge toward the rear of the chair 10, but it would still permit conformance of the seat support wall 52 to the contour of the person seated thereon.

When getting up, the person could slide his buttocks toward the rear of the animal simulated by the chair 10 (that is, toward a position more closely above his feet), and this action would have the effect of elevating the head. Again, the portion of the envelope 12 simulating the neck and head of the creature would be able to be maintained in any orientation desired, subject only to the constraints dictated by the envelope 12.

Numerous characteristics and advantages of the invention of this document have been set forth in the foregoing description. It will be understood, however, that this disclosure is, in many respects, only illustrative. Changes may be made in details, particularly in matters of shape, size, and arrangement of parts without exceeding the scope of the invention. The invention's scope is, of course, defined in the language in which the appended claims are expressed.

What is claimed is:

1. A chair, comprising:

(a) a flexible envelope having a first portion defining a reservoir therewithin, and a second portion disposed proximate a periphery of said first portion wherein said second portion can be extended upward from said first portion, an interior of said second portion communicating with said reservoir;

(b) a generally elongated member received in said second portion of said envelope and having a base extending downwardly into said reservoir; and (c) a quantity of fill occupying said reservoir and having said base of said elongated member immersed therein, said fill surrounding at least a lower portion of said base and having a consistency and a density such that it will tend to maintain said pillar-like member at a constant angle relative to a surface on which the chair is positioned when torqueing force, less than of a threshhold amount, is applied thereto, yet will permit angular adjustment of said pillar-like member relative to the surface on which the chair is positioned when torqueing force applied to said pillar-like member exceeds the threshold amount.

2. A chair in accordance with claim 1 wherein said generally elongated member is pillar-like in form and comprises:

(a) an elongated columnar element; and (b) a malleable block carried by said columnar element at an upper end thereof.

3. A chair in accordance with claim 2 wherein said elongated columnar element is formed form a high density urethane foam material.

4. A chair in accordance with claim 2 wherein said malleable block is formed from a low density urethane foam material.

5. A chair in accordance with claim 2 further comprising means for maintaining said generally pillar-like member extending within said second portion of said flexible envelope fully to an upper extremity thereof.

6. A chair in accordance with claim 5 wherein said envelope is shaped to take the form of a bird, said second portion of said envelope representing the neck and head of the bird and having button-like elements secured thereto at appropriate locations on opposite sides of said second portion of said envelope to represent eyes, and wherein said maintaining means comprises a cord interconnecting said button-like elements, said cord passing through said malleable block carried by said columnar element.

7. A chair in accordance with claim 1 wherein said fill comprises a multiplicity of expanded styrofoam beads.

8. A chair in accordance with claim 7 wherein said fill further comprises a quantity of shredded urethane foam.

9. A whimsical motif chair, comprising:

(a) a collapsible fabric bag simulating the body of a water fowl or other creature, said bag including a first portion, simulating the creature's torso, defining a reservoir therewithin, and a second portion, generally tubular in shape, simulating the creature's neck and head, disposed proximate a periphery of said first portion wherein said second portion can be extended upward from said first portion, an interior of said second portion communicating with said reservoir;

(b) a generally pillar-like member received in said second portion of said collapsible fabric gag, said pillar-like member having a base extending downwardly into said reservoir; and (c) a quantity of composite fill confined in said reservoir and being of a sufficient volume to give shape and form to said first portion of said fabric bag so that said first portion can reasonably accurately simulate the torso of the creature, said fill surrounding at least a portion of said base of said pillar-like member and having a consistency and density such that said fill will tend to maintain said pillar-like member at a constant angle relative to a surface on which the chair is positioned when force, less than a threshhold amount, is applied to said pillar-like member, yet will permit angular adjustment of said pillar-like member relative to the surface on which the chair is positioned when force applied to said pillar-like member exceeds the threshhold amount;

(d) wherein an upper wall, when the chair is positioned for use on the surface, of said first portion defines a seat surface, and said second portion, when the chair is in position on the surface, defines a back support.

10. A chair in accordance with claim 9 wherein said first portion of said fabric bag has formed therein, at at least one lateral side thereof, a fold defining a pouch at said lateral side, said fold simulating an anatomical part of said creature.

11. A chair in accordance with claim 10 wherein the creature is a water fowl, and wherein said fowl simulates a wing thereof.

12. A chair in accordance with claim 9 wherein said composite fill comprises a multiplicity of expanded styrofoam beads and, interspersed throughout said beads, a quantity of shredded urethane foam.

* * * * *